US011305245B2

(12) United States Patent
Ko

(10) Patent No.: US 11,305,245 B2
(45) Date of Patent: Apr. 19, 2022

(54) STIRRING ROD OF HOT AND COLD FOODS SUPPLYING MACHINE AND ASSEMBLED STIRRING UNIT THEREOF

(71) Applicant: MAING CHAU ENTERPRISE CO., LTD., Taoyuan (TW)

(72) Inventor: Yong-Teng Ko, Taoyuan (TW)

(73) Assignee: Maing Chau Enterprise Co., Ltd., Taoyuan (TW)

( * ) Notice: Subject to any disclaimer, the term of this patent is extended or adjusted under 35 U.S.C. 154(b) by 244 days.

(21) Appl. No.: 16/446,622

(22) Filed: Jun. 28, 2019

(65) Prior Publication Data

US 2020/0298189 A1 Sep. 24, 2020

(30) Foreign Application Priority Data

Mar. 19, 2019 (TW) ..... 108203311

(51) Int. Cl.

| | |
|---|---|
| ***B22C 5/00*** | (2006.01) |
| ***B01F 27/191*** | (2022.01) |
| ***B01F 27/1125*** | (2022.01) |
| ***B01F 27/114*** | (2022.01) |
| ***B01F 27/1144*** | (2022.01) |
| *B01F 101/06* | (2022.01) |

(52) U.S. Cl.

CPC ..... *B01F 27/191* (2022.01); *B01F 27/1125* (2022.01); *B01F 27/1141* (2022.01); *B01F 27/1144* (2022.01); *B01F 2101/06* (2022.01); *B01F 2215/0422* (2013.01)

(58) Field of Classification Search

CPC ..... B01F 7/00633; B01F 7/00425; B01F 7/00641; B01F 7/00291; B01F 15/00935; B01F 27/1141; B01F 2101/06

See application file for complete search history.

(56) References Cited

U.S. PATENT DOCUMENTS 6,033,105 A * 3/2000 Barker ..... A61B 17/8816 222/241
6,488,477 B1 * 12/2002 Hurr ..... B01F 7/02 417/234

(Continued)

FOREIGN PATENT DOCUMENTS

CN 201563586 U 9/2010
CN 203676909 U 7/2014

(Continued)

*Primary Examiner* — Anshu Bhatia
*Assistant Examiner* — Gregory Y Huan
(74) *Attorney, Agent, or Firm* — Rosenberg, Klein & Lee

(57) ABSTRACT

The present invention relates to a stirring rod of hot and cold foods supplying machine and an assembled stirring unit thereof. The assembled stirring unit includes an assembled piece and a stirring blade, wherein a length direction of the assembled piece is an axial direction, a direction perpendicular to the axial direction is a radial direction, and the assembled piece has a first joining piece and a second joining piece respectively at two ends thereof in the axial direction. The stirring blade is provided on the assembled piece and extends towards the radial direction, and the stirring blade is twisted at an angle by having the radial direction as an axis. The stirring rod is formed by serially connecting multiple assembled stirring units along the axial direction.

9 Claims, 12 Drawing Sheets

(56) References Cited

U.S. PATENT DOCUMENTS

| | | | | |
|---|---|---|---|---|
| 6,955,227 | B1 * | 10/2005 | Motosko | A01B 1/065 172/25 |
| 7,087,254 | B1 | 8/2006 | Wolfe et al. | |
| 2011/0261643 | A1 * | 10/2011 | Handa | B01F 7/00158 366/270 |
| 2018/0056251 | A1 * | 3/2018 | Hopkins | B29B 7/7447 |
| 2018/0343914 | A1 | 12/2018 | Wenger et al. | |
| 2019/0076802 | A1 * | 3/2019 | Seiler | B01F 7/00258 |

FOREIGN PATENT DOCUMENTS

| | | | |
|---|---|---|---|
| CN | 106073537 | A | 11/2016 |
| TW | M500228 | B | 5/2015 |
| TW | I617252 | | 3/2019 |
| WO | 2017166849 | A1 | 10/2017 |

* cited by examiner

STIRRING ROD OF HOT AND COLD FOODS SUPPLYING MACHINE AND ASSEMBLED STIRRING UNIT THEREOF

CROSS REFERENCES TO RELATED APPLICATIONS

The present application claims priority from Taiwanese Patent Application Serial Number 108203311, filed Mar. 19, 2019 the disclosure of which is hereby incorporated by reference herein in its entirety.

BACKGROUND OF THE INVENTION

(a) Field of the Invention

The present invention is related to a stirring rod of hot and cold foods supplying machine and an assembled stirring unit thereof and, more particularly, to an invention in which the stirring rod is formed by assembling multiple assembled stirring units and stirring blades of each assembled stirring unit are presented in specific twisting contour.

(b) Description of the Prior Art

In order to conveniently and quickly manufacture processed food materials, various food processors are available commercially, and one of the important core components in the food processors is the stirring rod; the stirring rod is capable of uniformly mixing different food materials, as well as ensuring food materials are uniformly heated or refrigerated during heating and refrigeration.

The stirring rod employed in the conventional food processors, for example, in R.O.C. Patent No. I617252 "SHAPING MACHINE FOR THICK-SOUP SOLIDS", or in R.O.C. Patent No. M500228 "MULTIFUNCTIONAL PROCESSING MACHINE", in which the stirring rods in said previous patents are integrally formed and both employ the sealed spiral contours.

However, regarding the integrally formed stirring rods, appropriate stirring rods are respectively required when the stirring rods are to be used in different machines and in tanks having different depths. Further, food materials close to the discharge end are squashed due to a great pressure or a pushing force by the conventional stirring blades in sealed spiral contours when the food materials are pushed from a feeding end to a discharge end; and so the stirring blades are inadequate to be used on food materials which require a sense of granules, whereby the great pressure sometimes even causes the stirring blades to be crushed and deformed.

SUMMARY OF THE INVENTION

Accordingly, the present invention provides an assembled stirring unit of a stirring rod of hot and cold foods supplying machine which includes an assembled piece and a stirring blade, wherein:

a length direction of the assembled piece is an axial direction, and a direction perpendicular to the axial direction is a radial direction; the stirring blade is provided on the assembled piece and extends towards the radial direction, and the stirring blade is twisted at an angle by having the radial direction as an axis.

The present invention further provides a stirring rod of hot and cold foods supplying machine, including: multiple assembled stirring units serially connected and assembled along an axial direction, wherein each of the assembled stirring units includes:

an assembled piece, wherein a length direction of the assembled piece is the axial direction and a direction perpendicular to the axial direction is a radial direction; and a stirring blade selectively disposed on the assembled piece and extending towards the radial direction, in which the stirring blade is twisted at an angle by having the radial direction as an axis, the stirring blades collectively form a spiral blade along the axial direction, and the spiral blade has at least one notch.

Preferably, lateral sides of the stirring blades of adjacent assembled stirring units are not joined adjacently and thereby form the notch therebetween. In one embodiment, each of the stirring blades is a 60-degree arc-shaped plate having a twist angle of 60 degrees. In another embodiment, the stirring blade of the assembled stirring unit located at a position adjacent to one end portion of the stirring rod is a 300-degree arc-shaped plate having a twist angle of 30 degrees. In still another embodiment, the stirring blades of three said assembled stirring units which are respectively located at positions adjacent to two end portions and a middle portion of the stirring rod are respectively a 300-degree arc-shaped plate having a twist angle of 30 degrees. In yet another embodiment, the stirring blades of said assembled stirring units include at least one 60-degree arc-shaped plate having a twist angle of 60 degrees and at least one 300-degree arc-shaped plate having a twist angle of 30 degrees, wherein the stirring blades of different degrees and twist angles are arranged alternately. In further another embodiment, each of the stirring blades is a 300-degree arc-shaped plate having a twist angle of 30 degrees, wherein in adjacent assembled pieces, one of which is provided with the stirring blade and the other is not.

Preferably, each of the stirring blades is an arc-shaped plate being greater than 360 degrees and is provided with a through hole for forming the notch.

Preferably, each of the stirring blades is an arc-shaped plate being greater than 360 degrees and is provided with a groove inwardly concaved on the periphery thereof for forming the notch.

Preferably, an assembly rod penetratingly extends through the assembled piece of each of each of the assembled stirring units so as to serially connect each of the assembled stirring units. Moreover, inner surfaces of the assembly rod and the assembled pieces both have non-circular cross sections.

Preferably, a base is serially connected the assembled stirring unit located at a position adjacent to one end portion of the stirring rod.

Preferably, the assembled piece has a first joining piece and a second joining piece respectively at two ends thereof in the axial direction, in which the first joining piece of one of the adjacent assembled stirring units is coupled with the second joining piece of the other adjacent assembled stirring unit. Furthermore, the first joining piece and the second joining piece may be an insert block and an insert slot corresponding to each other.

The following effects are preferably achieved according to the above-mentioned technical features:

1. The stirring rod can be assembled by using assembled stirring units so as to adapt the stirring rod to discharge cylinders having different depths.
2. The stirring blades collectively form a non-sealed spiral blade with notch(es) disposed about the axial direction, so that food materials are subjected to less pressure even when they are at a front end of a discharge cylinder;

therefore, the stirring rod of the present invention is capable of generating the effect of spiral stirring, while at the same time the food materials at the front end of the discharge cylinder are not squashed due to excessive pressure, and the stirring blade is not deformed and damaged due to an excessive squeezing force.

3. The selection of a stirring blade having a greater arc is capable of generating a greater pushing force; therefore, stirring blades having different arcs can be selected according to the density of different food materials; for example, a stirring blade having an arc of 300 degrees can be used when a greater pushing force is required for stirring a thick ice cream.
4. An assembly rod is used to serially connect the assembled stirring units, so that the stirring rod is enabled to rotate and stir more stably in a discharge cylinder without vibrating and subsequently impacting on the discharge cylinder.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

In summary of the above-mentioned technical features, the main effects of a stirring rod of hot and cold foods supplying machine and an assembled stirring unit thereof can be clearly presented by the following embodiments.

Figure 1:
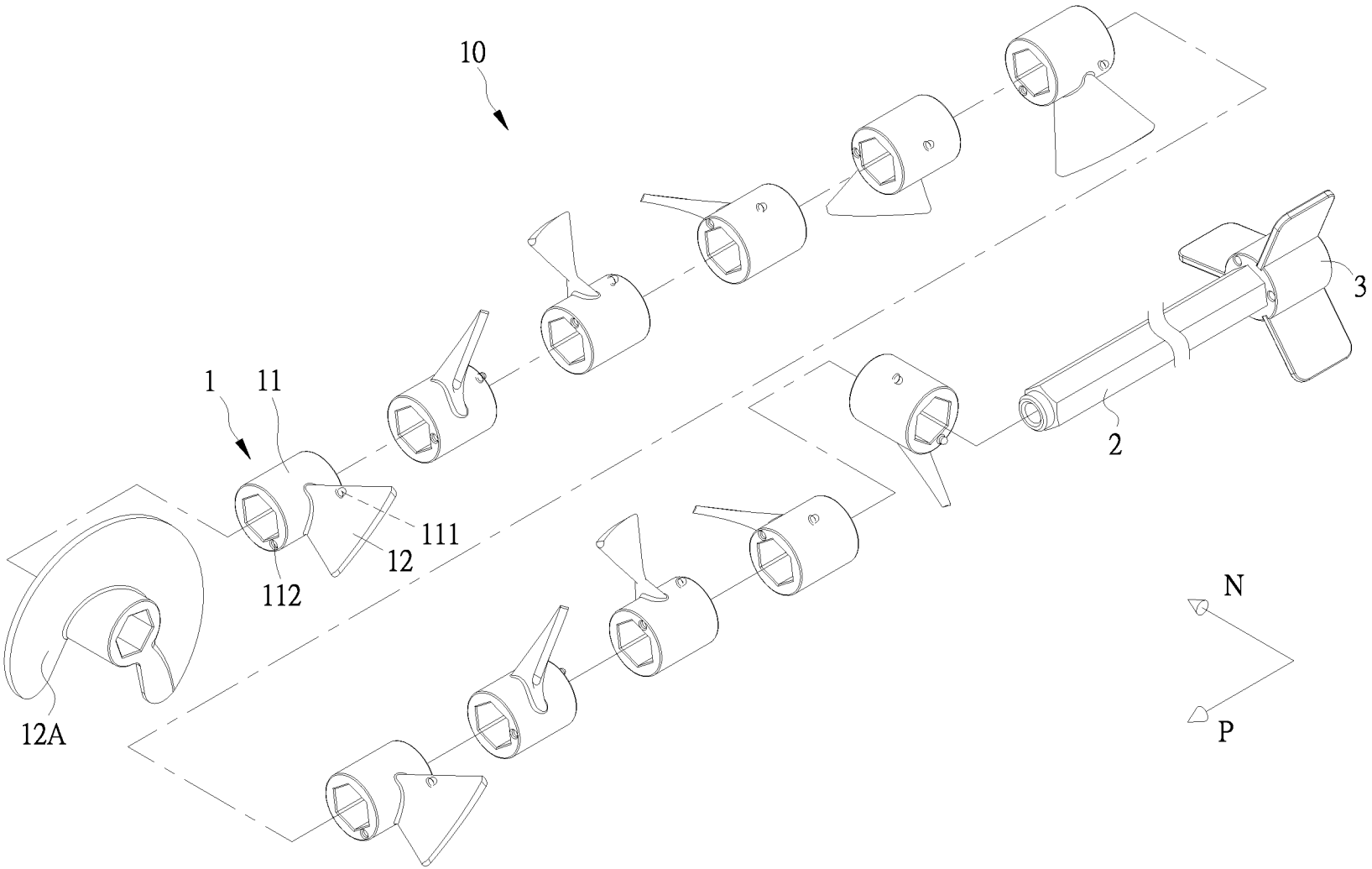
FIG. 1 is a three-dimensional exploded view showing a stirring rod according to the present invention.
Figure 2:
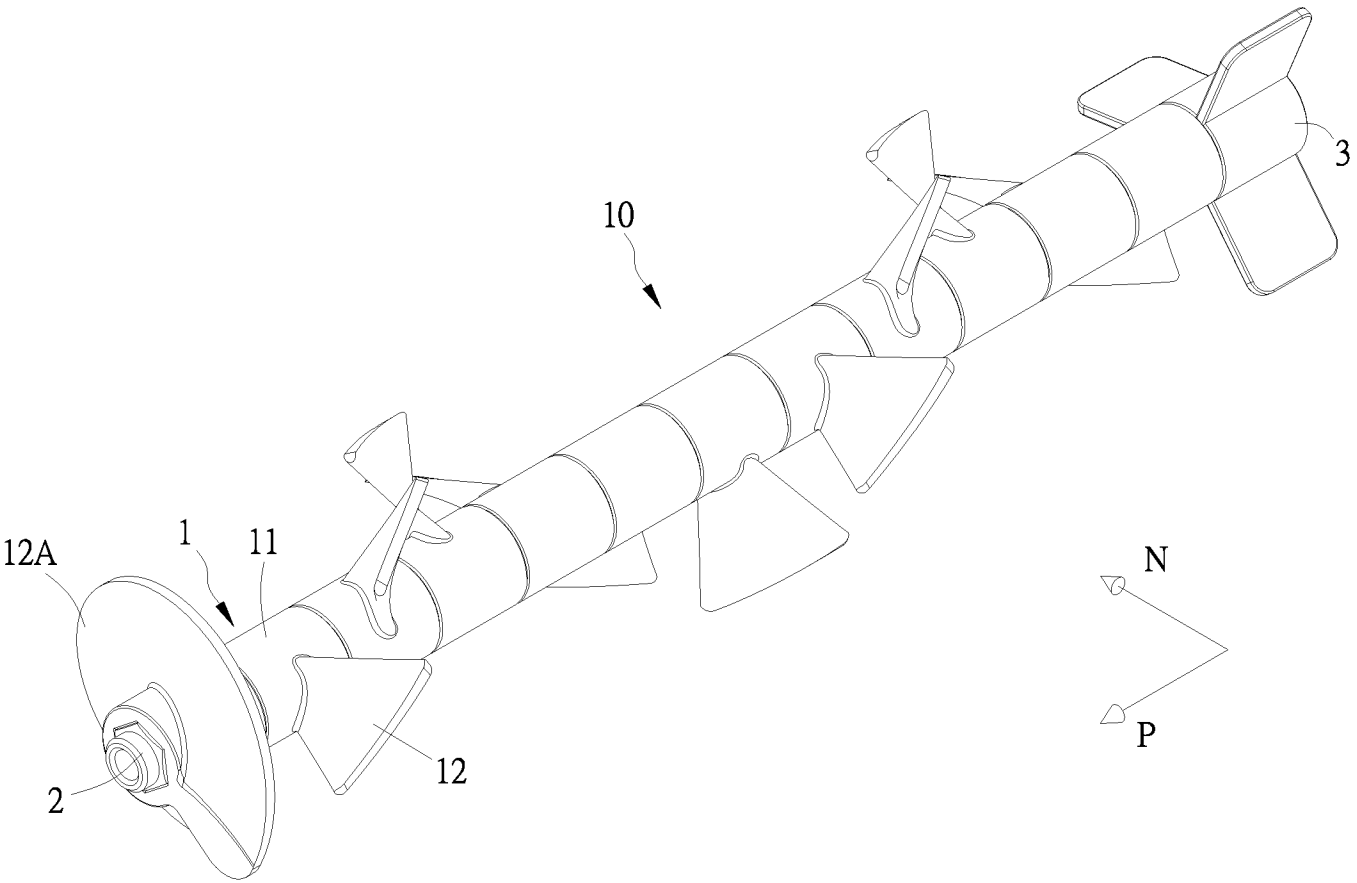
FIG. 2 is a three-dimensional assembled view showing the stirring rod according to the present invention.

Referring to FIGS. 1 and 2, a stirring rod (10) of the embodiment includes multiple assembled stirring units (1), an assembly rod (2), and a base (3) serially connected along an axial direction (P), in which each assembled stirring unit (1) includes an assembled piece (11) and a stirring blade (12), wherein:

a direction along the length of the assembled piece (11) is the axial direction (P), a direction perpendicular to the axial direction (P) is a radial direction (N), and the assembled piece (11) has a first joining piece (111) and a second joining piece (112) respectively at two ends thereof in the axial direction (P). The stirring blade (12) is disposed on the assembled piece (11) and extends towards the radial direction (N); the stirring blade (12) is less than 360 degrees in a direction surrounding the axial direction (P) and is preferably to be greater than 5 degrees and less than 360 degrees; the stirring blade (12) is twisted at an angle by having the radial direction (N) as an axis; in this embodiment, the stirring blade (12) is a 60-degree arc-shaped plate having a twist angle of 60 degrees. The stirring blades (12) of the multiple assembled stirring units (1) collectively form a spiral blade by means of a spiral arrangement, and lateral sides of the stirring blades (12) of adjacent assembled stirring units (1) form a notch (13) [refer to FIG. 4 for the notch (13)] on the spiral blade instead of being joined adjacently, so as to present a non-sealed spiral contours. Preferably, the assembled stirring unit (1) located at a position adjacent to one end portion of the stirring rod (10) includes a stirring blade (12A) that is a 300-degree arc-shaped plate having a twist angle of 30 degrees. The adjacent assembled stirring units (1) are joined together by coupling the first joining piece (111) of one of the adjacent assembled stirring unit (1) with the second joining piece (112) of the other adjacent assembled stirring unit (1). In this embodiment, the first joining piece (111) is an insert block, and the second joining piece (112) is an insert slot corresponding to the insert block. The base (3) is serially connected to the assembled stirring unit (1) located at a position adjacent to another end portion of the stirring rod (10), and the assembly rod (2) is penetratingly extended through the assembled piece (11) of each of the assembled stirring units (1) so as to serially connect each of the assembled stirring units (1); in order to prevent relative rotations between the assembly rod (2) and the assembled piece (11), inner surfaces of the assembly rod (2) and the assembled piece (11) have non-circular cross sections. Accordingly, stirring rods (10) having different lengths can be assembled so as to adapt to cylinders having different depths.

Figure 3:
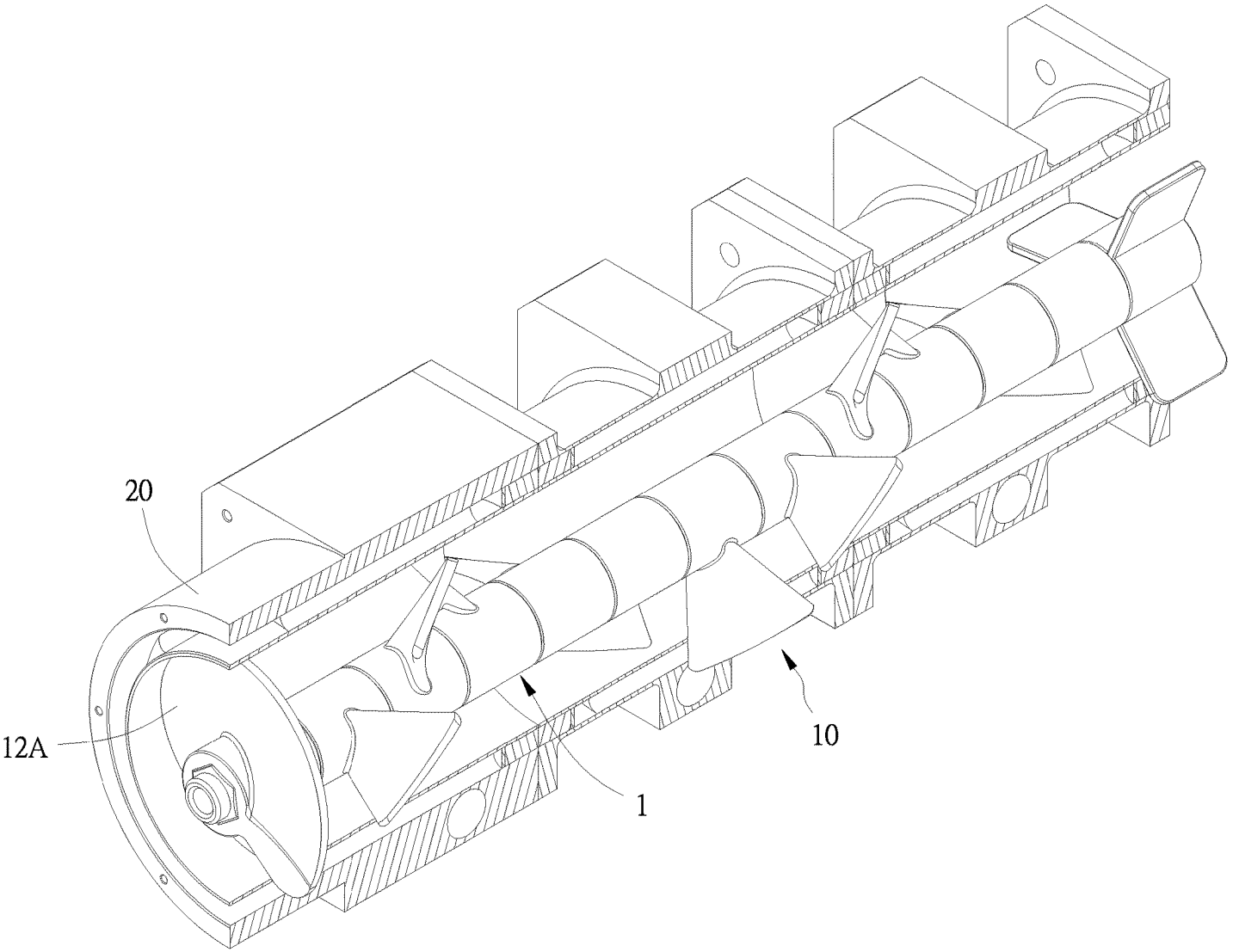
FIG. 3 is a schematic view showing the stirring rod being assembled with a discharge cylinder according to the present invention.
Figure 4:
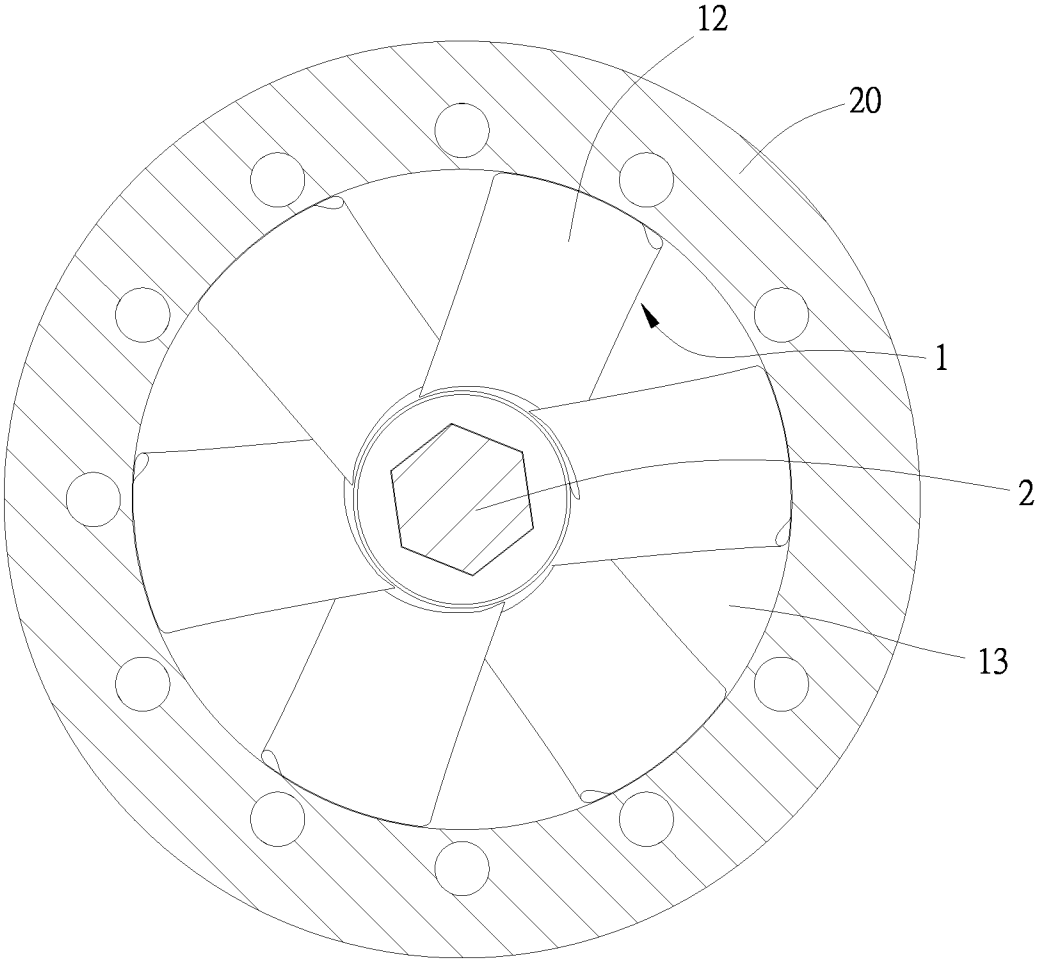
FIG. 4 is a schematic view showing an arrangement of a stirring blade of each assembled stirring unit in the stirring rod according to the present invention.

Referring to FIGS. 3 and 4, the stirring rod (10) is assembled in a discharge cylinder (20), in which the stirring blades (12) of the assembled stirring units (1) of the stirring rod (10) are arranged at an equal distance of 360 degrees, and each of the stirring blades (12) abuts against an inner wall of the discharge cylinder (20). By using the assembly rod (2) to serially connect the assembled stirring units (1), the stirring rod (10) is enabled to rotate and stir more stably in the discharge cylinder (20) without vibrating and subsequently impacting on the inner wall of the discharge cylinder. In addition, the stirring blade (12A) having a greater arc which is capable of generating greater force is selected for the purpose of discharging food materials more easily from the exit of the discharge cylinder (20).

Figure 5:
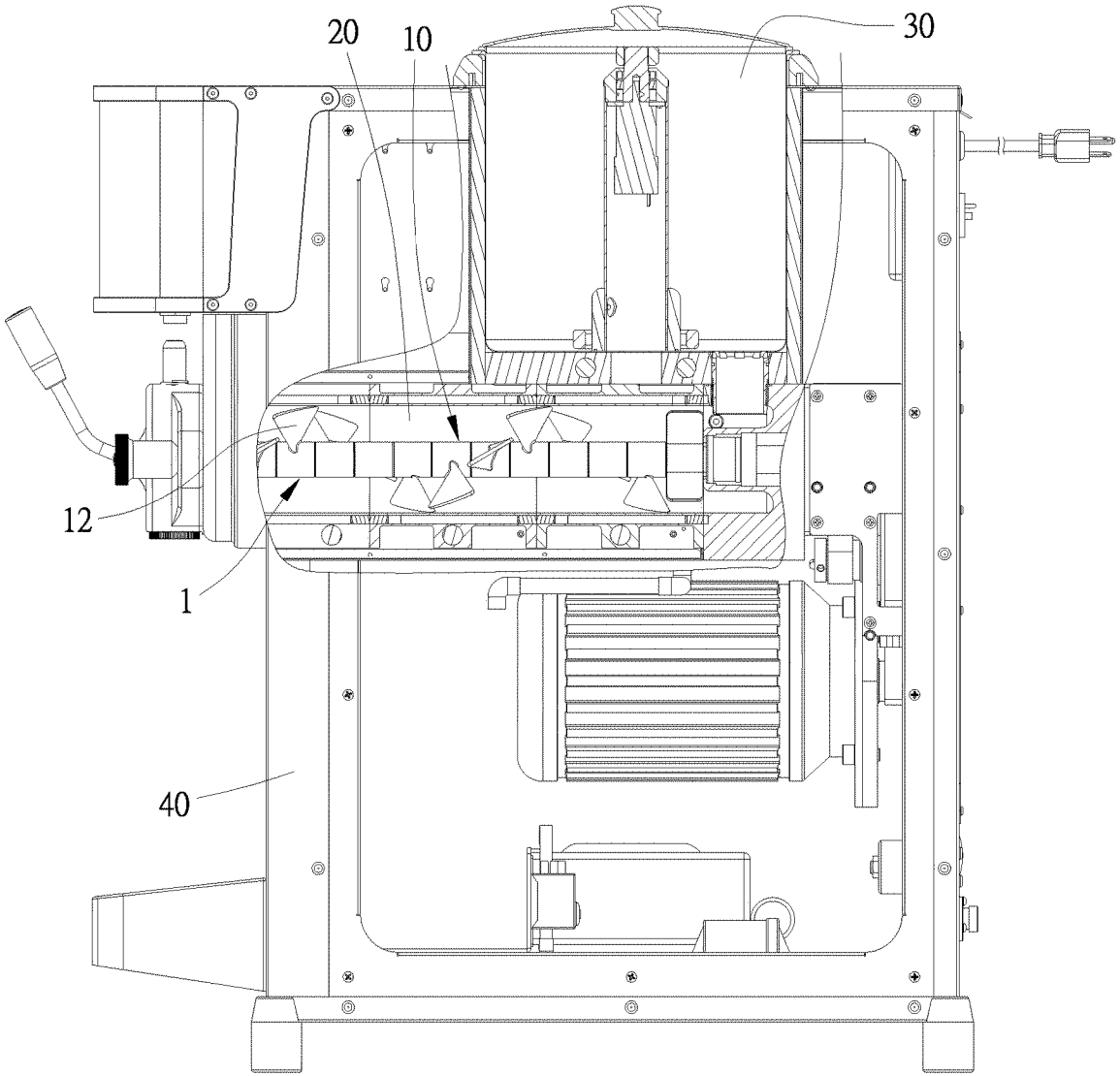
FIG. 5 is a schematic view showing the stirring rod being assembled on the hot and cold foods supplying machine according to the present invention.

Referring to FIGS. 4 and 5, the discharge cylinder (20) is assembled on a main engine (40) of hot and cold foods supplying machine, whereby the discharge cylinder (20) is connected to a feeding cylinder (30). Food materials are sufficiently mixed in the feeding cylinder (30) and then enter into the discharge cylinder (20) to be heated or refrigerated. When applied to hot porridges or other granular products, the stirring rod (10) assembled in the discharge cylinder (20) generates an effect of uniform mixing accompanied by spiral stirring, so that the hot porridges or other granular products can be uniformly heated. It is worth mentioning that, because of the non-sealed contour of the spiral blade, the hot porridges or other granular products are subjected to less pressure even when they are pushed and squeezed to a front end of the discharge cylinder (20). The non-sealed spiral blade, as described previously, is formed by the stirring blades (12) of the assembled stirring units (1) each of which is less than 360 degrees in the direction surrounding the axial direction (P) and assembled in such a way that the notch (13) is formed between the lateral sides of the stirring blades (12) of adjacent assembled stirring units (1). Therefore, the hot porridges or other granular products at the front end of the discharge cylinder (20) are not squashed due to an excessive pressure, and the stirring blades (12) are prevented from being deformed and damaged due to an excessive squeezing force.

Figure 6:
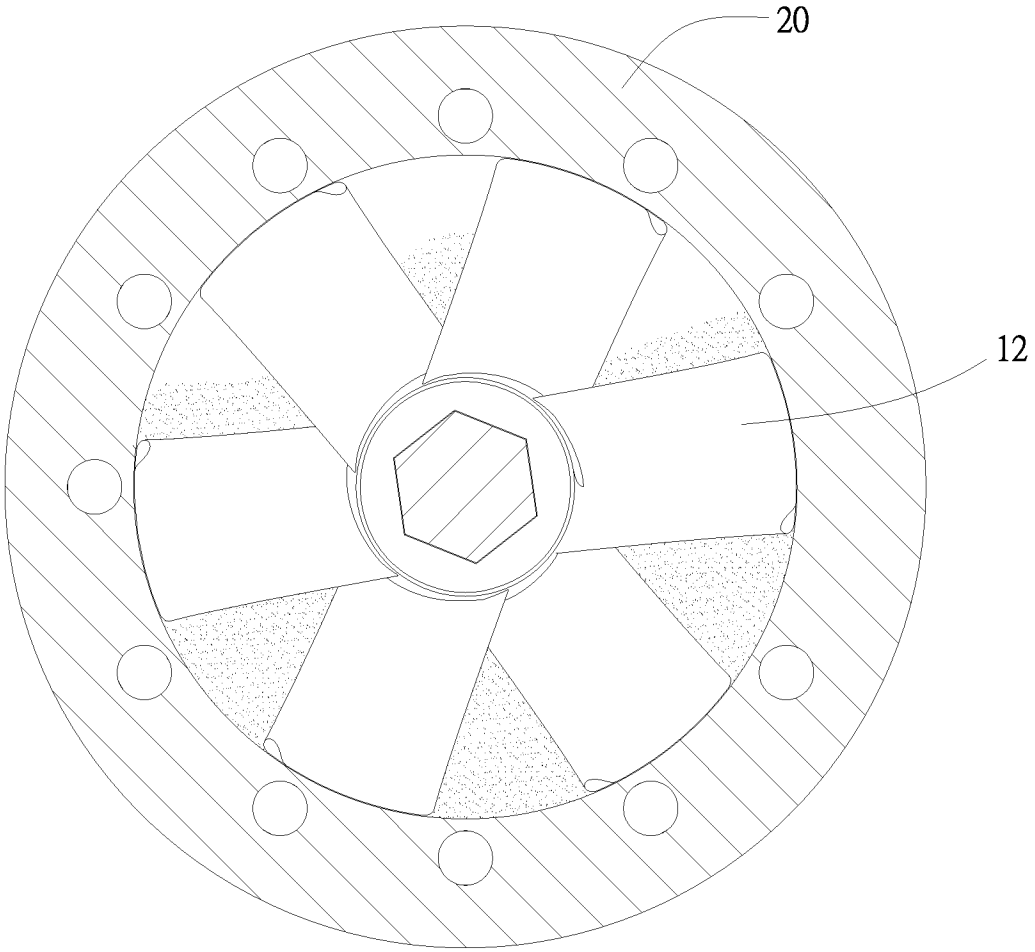
FIG. 6 is a schematic view showing the stirring blade being adjacent to an internal wall surface of the discharge cylinder and capable of scraping off food materials adhered to the internal wall surface of the discharge cylinder in accordance with the present invention.

Referring to FIG. 6, when the hot and cold foods supplying machine is used to supply dense food materials such as ice cream, the food materials are likely to become adhered to the inner wall of the discharge cylinder (20) due to a viscous effect; by having the stirring blade (12) abutting against the inner wall of the discharge cylinder (20), most of the food materials adhered to the inner wall of the discharge cylinder (20) can be scraped off, thereby preventing the food materials from being wasted.

Figure 7:
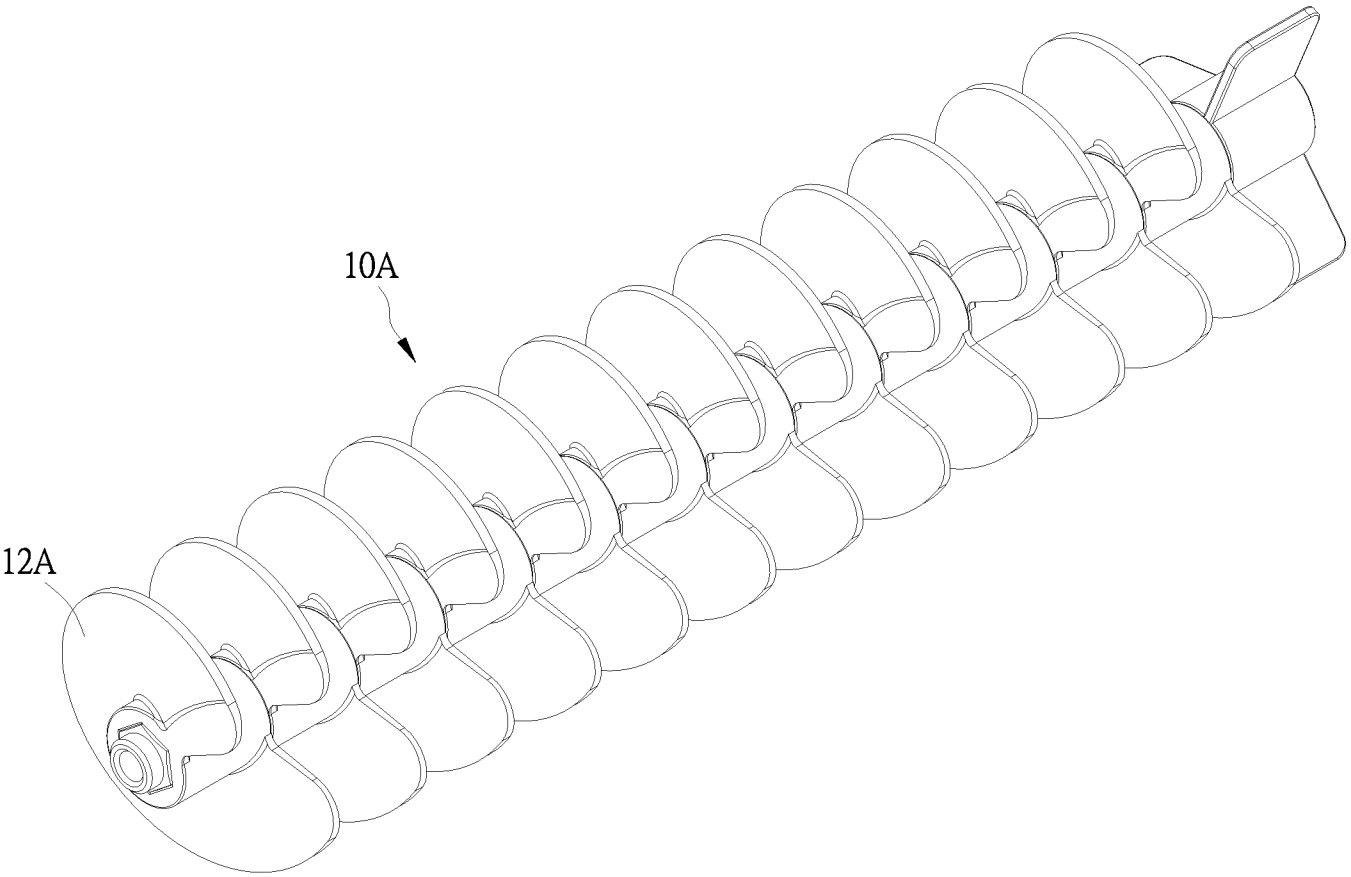
FIG. 7 is a schematic view showing the stirring blades on the stirring rod being presented at different angles according to the present invention.

Referring to FIG. 7, which shows another form of the stirring rod (10A); the stirring rod (10A) employs the stirring blades (12A) which all have an arc of 300 degrees and a twist angle of 30 degrees; as described previously, this is to generate a greater pushing force for pushing out stickier food materials.

Figure 8:
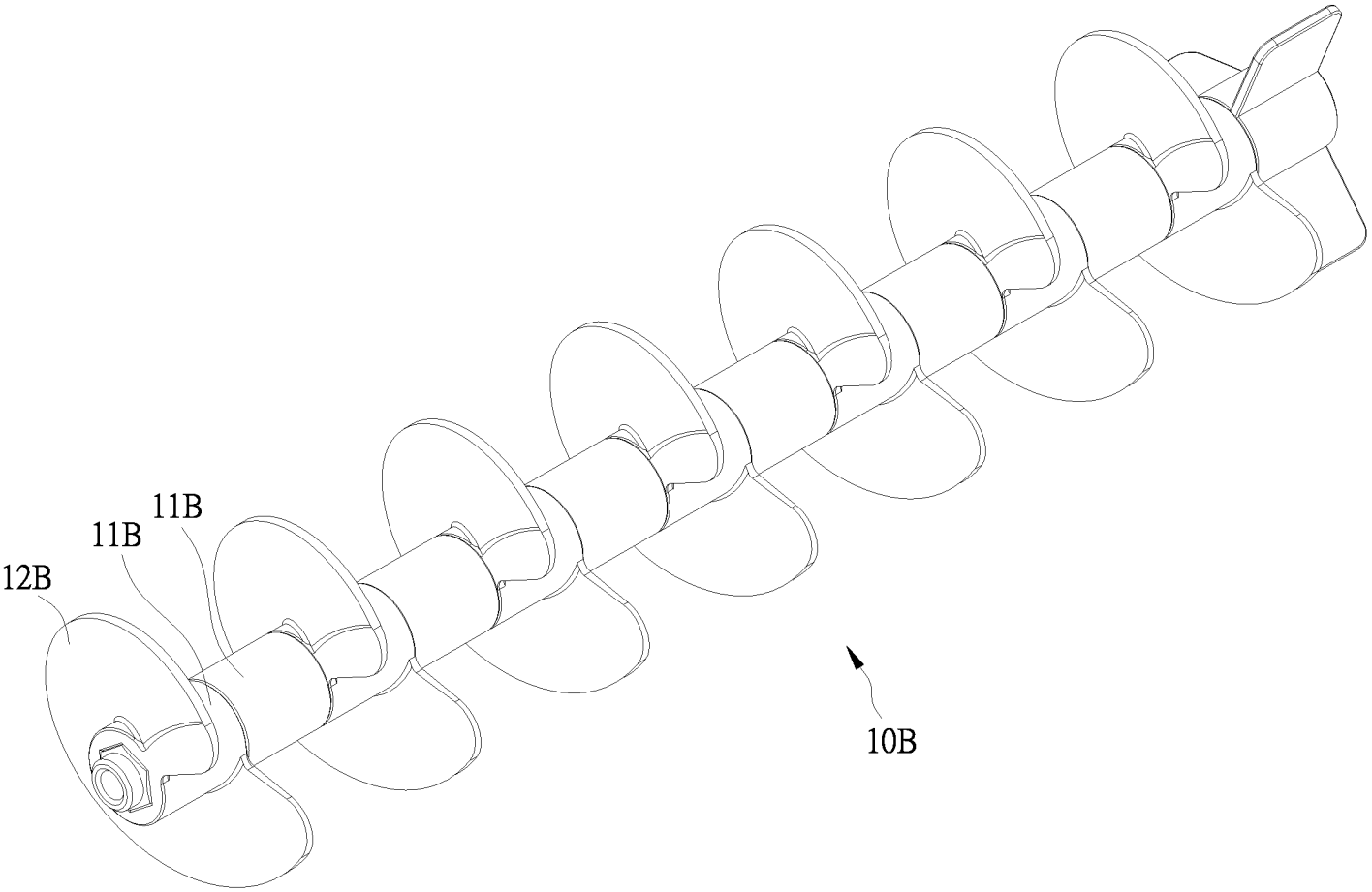
FIG. 8 is a schematic view showing a modified arrangement density for the stirring blades of FIG. 7.

Referring to FIG. 8, which shows a further form of the stirring rod (10B); the stirring rod (10B) has a plurality of assembled pieces (11B); in adjacent assembled pieces (11B), one of which is provided with a stirring blade (12B) while the other is not, and the stirring blade (12B) is a 300-degree arc-shaped plate having a twist angle of 30 degrees. The stirring blade (12B) having a lower density configured in this manner enables food materials to be transported more easily.

Figure 9:
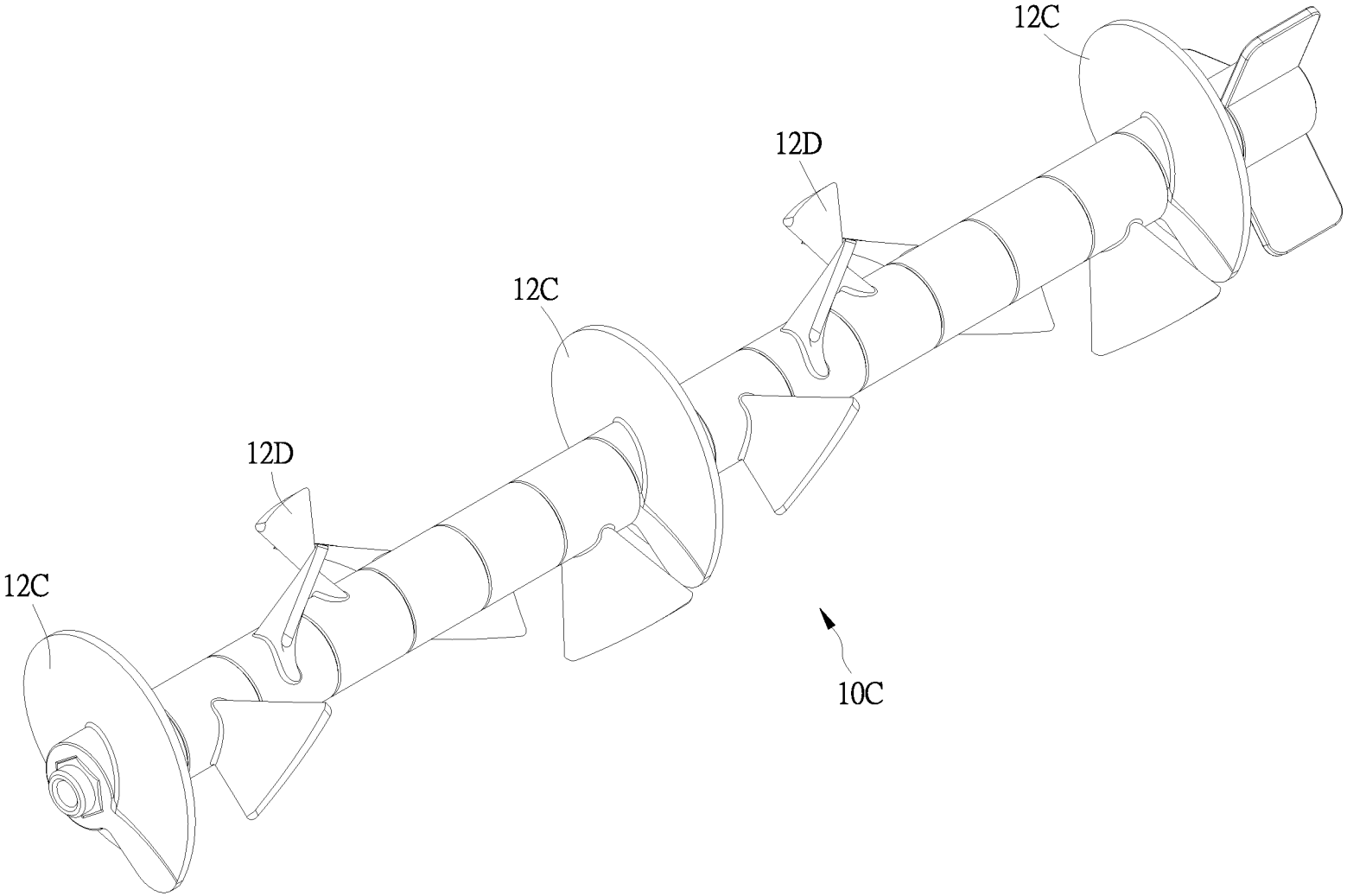
FIG. 9 is a schematic view showing that the stirring rod has stirring blades at two different angles which are presented in one of arrangement patterns according to the present invention.

Referring to FIG. 9, which shows yet another form of the stirring rod (10C); the stirring rod (10C) has stirring blades (12C) of assembled stirring units in two end portions and in the middle which are respectively a 300-degree arc-shaped plate having a bent angle of 30 degrees, and the stirring blades (12D) of the remaining assembled stirring units are respectively a 60-degree arc-shaped plate having a twist angle of 60 degrees. A pushing force of the stirring rod (10C) is changed by means of the stirring blade (12C) and the stirring blade (12D) having different angles and alternate arrangement forms thereof.

Figure 10:
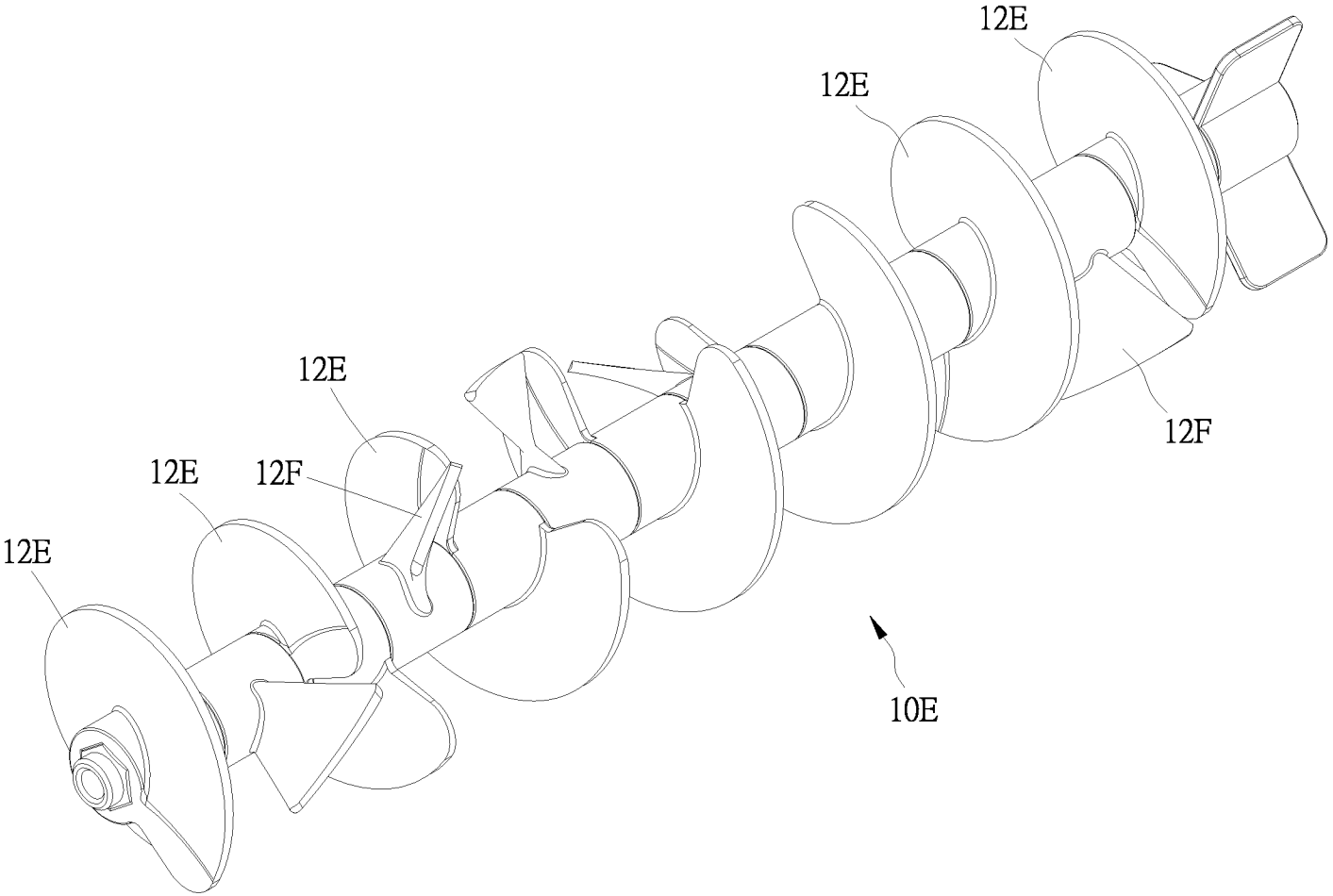
FIG. 10 is a schematic view showing that the stirring rod has stirring blades at two different angles which are presented in another arrangement pattern according to the present invention.

Referring to FIG. 10, which shows yet another form of the stirring rod (10E); the assembled stirring unit of the stirring rod (10E) includes a stirring blade (12E) which is a 60-degree arc-shaped plate having a twist angle of 60 degrees, and a stirring blade (12F) which is a 300-degree arc-shaped plate having a twist angle of 30 degrees, wherein the stirring blade (12E) and the stirring blade (12F) are alternately arranged. A pushing force of the stirring rod (10E) is changed by means of the stirring blade (12E) and the stirring blade (12F) having different angles and alternate arrangement forms thereof.

Figure 11:
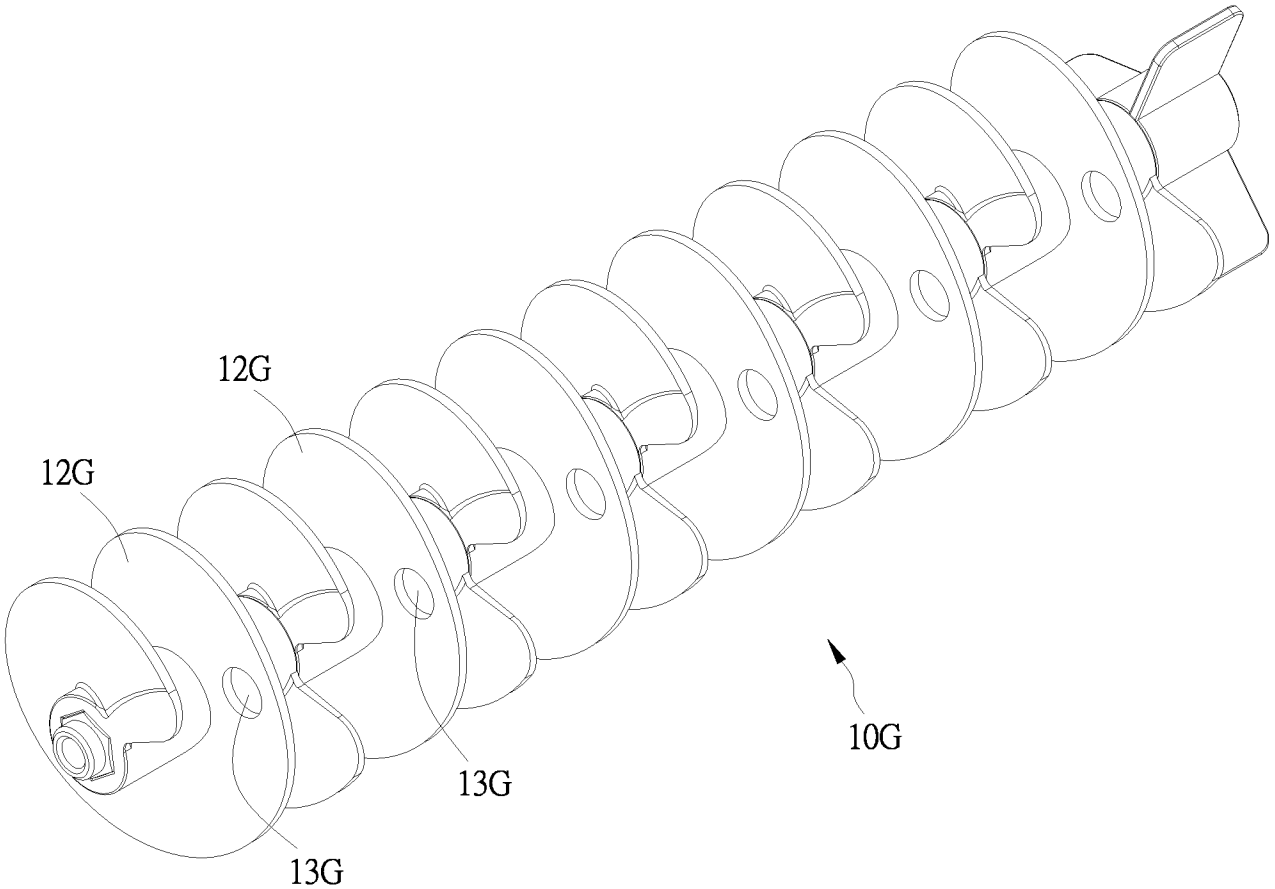
FIG. 11 is a schematic view showing that when the stirring blades of the stirring rod have a radian being greater than 360 degrees in the axial direction, through holes are formed on the stirring blades according to the present invention.

Referring to FIG. 11, which shows yet another form of the stirring rod (10G); the assembled stirring unit of the stirring rod (10G) includes a stirring blade (12G) which is presented to be 720 degrees, and a through hole (13G) provided on the stirring blade (12G), so as to present a non-sealed spiral contours, thereby achieving the effects of the above-mentioned embodiments.

Figure 12:
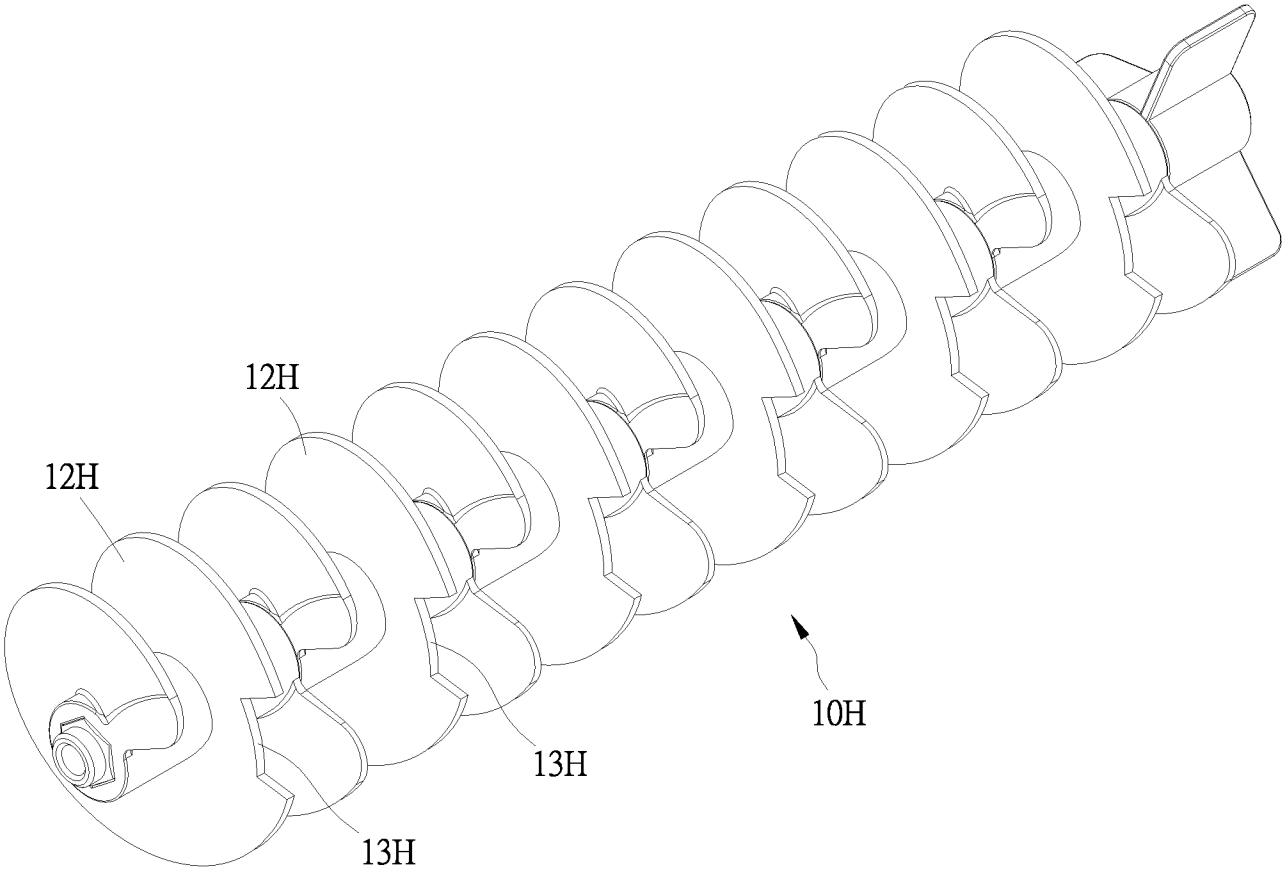
FIG. 12 is a schematic view showing that when the stirring blades of the stirring rod have a radian being greater than 360 degrees in the axial direction, notches are formed on the stirring blades according to the present invention.

Referring to FIG. 12, which shows yet another form of the stirring rod (10H); the assembled stirring unit of the stirring rod (10H) includes a stirring blade (12H) which is presented to be 720 degrees, and a groove (13H) inwardly concaved on the periphery of the stirring blade (12H), so as to present a non-sealed spiral contours, thereby achieving the effects of the above-mentioned embodiments.

The various contours of the stirring rod (10), the stirring rod (10A), the stirring rod (10B), the stirring rod (10C), the stirring rod (10E), the stirring rod (10G) and the stirring rod (10H) are used to explain that a user can select an adequate stirring rod according to a pushing force required for the density of different food materials.

In summary of the explanations of the above-mentioned embodiments, operations and uses of the present invention and effects produced by the present invention can be sufficiently understood. However, it should be understood that the aforesaid embodiments are merely preferred embodiments of the present invention and are not intended to limit the scope of the present invention; therefore, simple alterations and equivalent modifications based on the claims and the description of the present invention shall be likewise included within the scope of present invention.

What is claimed is:

1. An assembled stirring unit of a stirring rod of hot and cold foods supplying machine, comprising:

an assembled piece, a length direction of the assembled piece being an axial direction and a direction perpendicular to the axial direction being a radial direction, the assembled piece extending between first and second axially-opposed end portions, wherein an insert block is disposed at the first end portion of the assembled piece and extends axially away therefrom, and wherein an insert slot is formed in the second end portion of the assembled piece; and a stirring blade provided on the assembled piece and extending towards the radial direction, wherein the stirring blade is a 60-degree arc-shaped plate twisted at an angle of 60 degrees by having the radial direction as an axis.

2. A stirring rod of hot and cold foods supplying machine, comprising multiple assembled stirring units serially connected and assembled along an axial direction, each of the assembled stirring units includes:

an assembled piece, a length direction of the assembled piece being the axial direction and a direction perpendicular to the axial direction being a radial direction, and the assembled piece extending between first and second axially-opposed end portions, wherein an insert block is disposed at the first end portion of the assembled piece and extends axially away therefrom, and wherein an insert slot is formed in the second end portion of the assembled piece; and a stirring blade provided on the assembled piece and extending towards the radial direction, wherein the stirring blade is twisted at an angle by having the radial direction as an axis;

wherein respective assembled pieces of adjacent corresponding assembled stirring units are connected one to another and devoid of threaded fasteners, the insert block of one assembled piece being received within the insert slot of a corresponding adjacent assembled piece;

wherein the stirring blades of the multiple assembled stirring units collectively form a spiral blade along the axial direction and the spiral blade has at least one notch, and lateral sides of the stirring blades of adjacent assembled stirring units are not joined adjacently, thereby forming the notch therebetween; and wherein each of the stirring blades is a 60-degree arc-shaped plate having a twist angle of 60 degrees.

3. The stirring rod of claim 2, wherein an assembly rod penetratingly extends through the assembled piece of each of the assembled stirring units so as to serially connect each of the assembled stirring units.

4. The stirring rod of claim 3, wherein an outer surface of the assembly rod and inner surfaces of the assembled pieces, along the axial direction, both have non-circular cross sections.

5. The stirring rod of claim 2, wherein a base is serially connected to the assembled stirring unit located at a position adjacent to one end portion of the stirring rod.

6. A stirring rod of hot and cold foods supplying machine, comprising multiple assembled stirring units serially connected and assembled along an axial direction, each of the assembled stirring units includes:

an assembled piece, a length direction of the assembled piece being the axial direction and a direction perpendicular to the axial direction being a radial direction, and the assembled piece extending between first and second axially-opposed end portions, wherein an insert block is disposed at the first end portion of the assembled piece and extends axially away therefrom, and wherein an insert slot is formed in the second end portion of the assembled piece; and a stirring blade provided on the assembled piece and extending towards the radial direction, wherein the stirring blade is twisted at an angle by having the radial direction as an axis;

wherein respective assembled pieces of adjacent corresponding assembled stirring units are connected one to another and devoid of threaded fasteners, the insert block of one assembled piece being received within the insert slot of a corresponding adjacent assembled piece;

wherein the stirring blades of the multiple assembled stirring units collectively form a spiral blade along the axial direction and the spiral blade has at least one notch, and lateral sides of the stirring blades of adjacent assembled stirring units are not joined adjacently, thereby forming the notch therebetween; and wherein the stirring blades of the assembled stirring units include at least one 60-degree arc-shaped plate having a twist angle of 60 degrees and at least one 300-degree arc-shaped plate having a twist angle of 30 degrees, wherein the stirring blades of different degrees and twist angles are arranged alternately.

7. The stirring rod of claim 6, wherein an assembly rod penetratingly extends through the assembled piece of each of the assembled stirring units so as to serially connect each of the assembled stirring units.

8. The stirring rod of claim 7, wherein an outer surface of the assembly rod and inner surfaces of the assembled pieces, along the axial direction, both have non-circular cross sections.

9. The stirring rod of claim 6, wherein a base is serially connected to the assembled stirring unit located at a position adjacent to one end portion of the stirring rod.

* * * * *